United States Patent [19]

Brown

[11] Patent Number: 4,608,134

[45] Date of Patent: Aug. 26, 1986

[54] HALL CELL WITH INERT LINER

[75] Inventor: Melvin H. Brown, Freeport, Pa.

[73] Assignee: Aluminum Company of America, Pittsburgh, Pa.

[21] Appl. No.: 725,622

[22] Filed: Apr. 22, 1985

[51] Int. Cl.[4] ..... C25C 3/08; C25C 3/22

[52] U.S. Cl. ..... 204/67; 204/243 R; 204/246; 204/247; 204/274; 204/284; 204/294; 204/241

[58] Field of Search ..... 204/67, 243 R-247, 204/294, 241, 274, 284

[56] References Cited

U.S. PATENT DOCUMENTS

| | | | |
|---|---|---|---|
| 3,470,075 | 9/1969 | Johnson | 204/247 X |
| 3,729,399 | 4/1973 | Kibby | 204/246 X |
| 4,033,846 | 7/1977 | Engesland | 204/247 |
| 4,087,345 | 5/1978 | Sandvik et al. | 204/243 R |
| 4,222,841 | 9/1980 | Miller | 204/274 X |
| 4,410,403 | 10/1983 | Jacobs et al. | 204/243 R X |
| 4,425,200 | 1/1984 | Arita | 204/67 |

*Primary Examiner*—Donald R. Valentine

*Attorney, Agent, or Firm*—Andrew Alexander; John P. Taylor

[57] ABSTRACT

The invention comprises an improved Hall cell for electrolytic reduction of aluminum from a molten salt bath having a carbon cathode bottom wall and sidewall, a cover over said cell, at least one anode within said cell depending from an anode support rod passing through said cover, conductive means over the carbon bottom wall to reduce the spacing between the anode and the cathode, and protective sidewall lining means relatively inert to attack by the molten salt bath on the inner surface of the carbon sidewall. Cooling means are provided to cool an upper portion of the sidewall lining adjacent the surface of the molten salt bath to promote the formation of a protective layer of frozen bath over the exposed portion of the sidewall lining adjacent the surface of the molten salt bath while retaining within the cell at least a portion of the heat removed from the sidewall lining.

20 Claims, 3 Drawing Figures

HALL CELL WITH INERT LINER

BACKGROUND OF THE INVENTION

1. Field of the Invention

This invention relates to the electrolytic reduction of aluminum in a Hall cell. More particularly, this invention relates to improvements in a Hall cell which permit more efficient operation thereof.

2. Background Art

In the normal operation of a Hall cell, spacing between the anode and the cathode is adjusted to provide sufficient power consumption to not only reduce the alumina to aluminum but to generate sufficient heat to maintain, in a molten state, the salt bath in which the alumina is dissolved.

However, due to erosion of the carbon lining cathode walls of the bath by reaction with the molten salt or the molten aluminum, as it is formed, the cell is conventionally operated at a temperature which permits solidification of a certain amount of the bath on the carbon sidewalls of the cell. This frozen bath lining, then, acts as a protective liner to prevent interaction between the carbon sidewalls and the molten portion of the salt bath.

Due to the ever increasing costs of electricity and the concurrent need to conserve energy resources, there has been an increased interest in raising the efficiency of the Hall cell operation. It has long been known that a reduction in the spacing between the anodes of the cell and the cathode bottom wall would reduce the power consumption ($I^2R$) of the cell. However, a Hall cell does not operate in a quiescent state, and the movement of the molten aluminum in the cell during normal operation could result in shorting out of the cell if the spacing was reduced.

More recently, however, relatively inert conductive cathode materials have been developed which may be used over the carbon cathode bottom wall, for example, in particulate form as a layer spread on top of the carbon cathode bottom wall of the call, to effectively extend the cathode upward toward the anode and thus reduce the anode-cathode spacing. Such materials, which include $TiB_2$, TiN, $ZrB_2$ or $NbB_2$, may also be used in shaped forms such as plates or the like. When used in such a form, openings are provided through which the molten aluminum may flow so that the inert cathode material, not the molten aluminum, is spaced closest to the anode.

While such an approach is, indeed, satisfactory for the reduction of power consumption in a Hall cell, a concurrent problem has arisen with regard to maintenance of the frozen bath protective lining on the carbon sidewalls of the cell. This is because the reduced power consumption of the cell results in less heat generated so that if sufficient heat is removed from the cell through the sidewalls to permit the formation of a frozen bath lining, as in the prior art operation of the cell, the temperature of the cell may be lowered to a dangerous point wherein the entire cell may freeze over.

It, thus, would be desirable to provide a Hall cell having a closer spacing between the anode and cathode, to thereby reduce the amount of power consumed, while still protecting the sidewalls of the cell from erosion and without endangering the operation of the cell due to cell freeze-up.

To compensate for the absence, or substantial absence of a protective layer of frozen bath formed over the carbon cathode sidewall, a liner could be used over the carbon cathode sidewall which would protect the carbon from direct contact with the molten aluminum. Unfortunately, however, candidate materials for such a liner which are capable of resisting reduction by contact with the molten salt bath are usually oxidized at the interface at the top of the bath, i.e., the interface between the molten bath and the frozen crust over the bath.

SUMMARY OF THE INVENTION

It is, therefore, an object of the invention to provide an improved Hall cell wherein the cathode-anode spacing is reduced to permit more efficient operation of the cell with lower heat generation.

It is another object of the invention to provide an improved Hall cell wherein the cathode-anode spacing is reduced to permit more efficient operation of the cell with lower heat generation, and an inert liner is used to protect the carbon cathode wall of the cell in the substantial absence of a frozen layer over the wall.

It is yet another object of the invention to provide an improved Hall cell wherein the cathode-anode spacing is reduced to permit more efficient operation of the cell with lower heat generation and an inert liner is used to protect the carbon cathode wall of the cell in the substantial absence of a frozen layer over the wall and wherein a frozen layer of bath is formed over the exposed portion of the liner adjacent the interface between the liquid bath and the frozen crust thereover.

It is a further object of the invention to provide an improved Hall cell wherein the cathode-anode spacing is reduced to permit more efficient operation of the cell with lower heat generation, and an inert liner is used to protect the carbon cathode wall of the cell in the substantial absence of a frozen layer over the wall, and wherein a frozen layer of bath is formed over the exposed portion of the liner adjacent the interface between the liquid bath and the frozen crust thereover by means which cool the carbon cathode wall and the inert liner adjacent the liquid bath-frozen crust interface, while retaining in the cell at least a portion of the heat so removed.

These and other objects of the invention will be apparent from the following description and accompanying drawing.

In accordance with the invention, an improved Hall cell for electrolytic reduction of aluminum from a molten salt bath comprises a carbon cathode bottom wall and sidewall, a cover over the cell, at least one anode within the cell depending from an anode support rod passing through the cover, stable conductive cathode means over the carbon bottom wall to reduce the spacing between the anode and the cathode, increased insulation on the sidewall to reduce heat loss, protective sidewall lining means relatively inert to attack by molten salt bath on the inner surface of the carbon sidewall, and cooling means to cool an upper portion of the sidewall lining adjacent the surface of the molten salt bath to promote the formation of a protective layer of frozen bath over the exposed portion of the sidewall lining adjacent the surface of the molten salt bath while retaining within the cell at least a portion of the heat removed from the sidewall lining.

DESCRIPTION OF THE PREFERRED EMBODIMENT

The improved Hall cell of the invention provides reduced anode-cathode spacing to lower the power consumption and raise the efficiency of the Hall cell. The improved cell thereby produces less heat which can, in turn, interfere with the conventional formation of a protective layer of frozen bath on the carbon cathode sidewall of the cell. To compensate for this, in accordance with the invention, increased insulation is placed on the sidewall and a protective liner is placed over the inner surface of the carbon cathode sidewall. The portion of the liner above the level of the molten salt bath is, in turn, protected against oxidation by the local formation of a frozen bath segment coating only this portion of the liner. This is accomplished by only cooling the upper, exposed portion of the liner with cool air which, in a preferred embodiment, is then circulated over the top of the bath to retain within the cell at least a portion of the heat so extracted.

Figure 1:
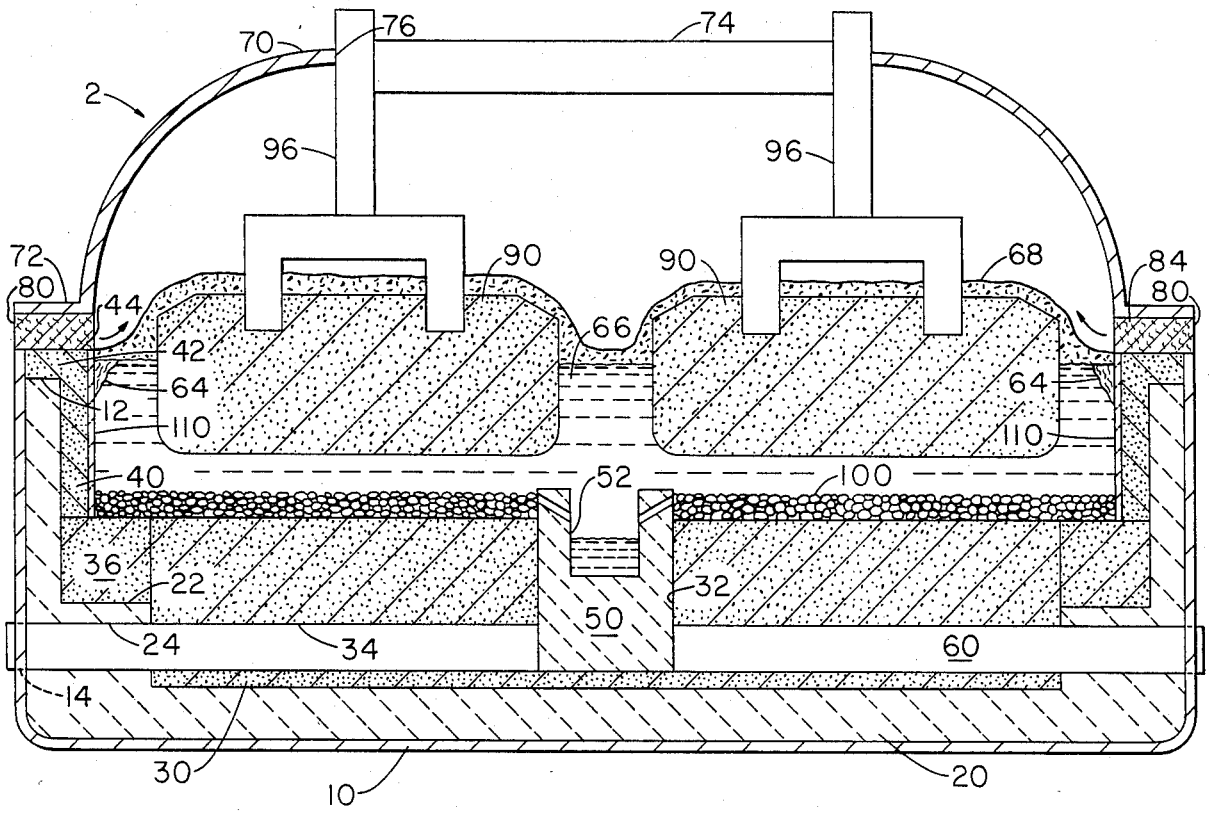
FIG. 1 is a cross-sectional view of the improved Hall cell of the invention.

Referring now to FIG. 1, the improved Hall cell of the invention is generally indicated at 2. A steel shell or containment vessel 10 having a bottom wall and a sidewall is interiorly lined with insulation layer 20 which terminates at a point 12 below the top of the sidewall of containment vessel 10. As referred to previously, insulation layer 20, preferably, is somewhat thicker than conventional insulation due to the low heat output of the cell which makes conservation of heat more important to prevent cell freeze up.

The bottom of Hall cell 2 is provided with a carbon cathode lining which, in the illustrated embodiment, comprises one or more large carbon blocks 30 which are placed over the bottom portion of insulation layer 20 and smaller carbon blocks 36 which are placed on ledges 22 cut from the sidewalls of insulation layer 20.

The carbon bottom blocks 30 are formed with a large central groove 32 into which is fitted reception vessel 50 having a sump 52 therein to receive molten aluminum as it forms in cell 2. Reception vessel 50 is formed of a material, such as a $TiB_2$, TiN, $ZrB_2$ or $NbN_2$ material which is resistive to attack by the molten salt bath.

One or more metal collector bars 60 pass through bores 14, 24 and 34, respectively, in containment vessel 10, insulation layer 20, and carbon blocks 30 to connect the carbon cathode blocks 30 to the negative side of a current supply source either directly or through adjacent cells in series with cell 2.

Cell 2 is also provided with a carbon cathode sidewall comprising carbon sidewall block 40. Sidewall block 40 is positioned within insulation lining 20 and is further provided with a portion 42 which extends upwardly beyond termination point 12 and over insulation layer 20 to contact containment vessel 10, as will be further described below.

A cover 70 is positioned over containment vessel 10. A lip 72 on cover 70 defines, in cooperation with upper surface 44 of portion 42 of carbon sidewall 40, an air entrance port 80.

Cover 70 has a central air exit port 74 to exhaust air entering cell 2 through entrance port 80 as well as for removal of any gases generated during the electrolytic reduction process.

Anode support rods 96 pass through bores 76 in cover 70 and serve to both physically support and carry current to anodes 90. Anodes 90 comprise carbon blocks having a lower surface 92 which is positioned above carbon cathode blocks 30.

In accordance with one aspect of the invention, the spacing between cathode blocks 30 and anode 90 is foreshortened by the presence of conductive material 100 which is placed over carbon cathode blocks 30 to effectively shorten the spacing or gap through the molten salt bath 66 to surface 92 of anode 90. Conductive material 100 may comprise a particulated conductive material which is resistant to attack by molten salt bath, such as the same material forming reception vessel 50, e.g. $TiB_2$. Alternatively, as previously discussed, formed shapes of such materials such as plates may be used with holes therein to permit flowthrough of the molten aluminum as it forms. Conductive material 100, when in particulated form, preferably has a particle size of about 1 to 5 centimeters. The presence of the relatively inert conductive material 100 decreases the anode-cathode gap while permitting the molten aluminum to flow, as it is formed, to a level below the upper surface of inert conductive material 100 so that material 100 is always closest to the anode.

Decreasing the anode-cathode distance results in a reduction in the power consumption flow which, in turn, reduces the amount of heat generated by cell 2. This reduction of heat makes it unfeasible to form the conventional frozen bath layer over the entire inner surface of carbon cathode sidewall 40.

Therefore, in accordance with the invention, the inner surface of carbon sidewall 40 is lined with a conductive liner 110 comprising a conductive material resistant to attack by the molten salt bath. Liner 110 may be constructed, for example, of $TiB_2$ or any of the other materials which may comprise inert conductive material 100, as previously discussed.

Such materials, however, must be protected from oxidation of the exposed portion of liner 110 above the molten bath level at the elevated temperatures at which such electrolytic cells operate. That is, that portion **110*a* commencing at the interface between molten bath 66 and frozen crust 68** thereon must be protected.

Protection for this exposed portion **110*a* of liner 110 is provided by selectively freezing a portion of molten bath 66 over the exposed surface of the liner at 64. This is accomplished by admitting cool air into cell 2 through air inlet ports 80. The cool air passing over surface 44 of upper portion 42 of carbon sidewall blocks 40 extracts sufficient heat from carbon block 40 to permit the localized freezing at 64. The extracted heat, however, in the preferred embodiment, is at least partially returned to cell 2 by passing the heated air over the frozen crust 68 of bath 64 before exhausting the air through exit port 74. Freeze-up of cell 2** by excessive heat removal is thus inhibited.

To form the frozen portions 64, cell 2 is initially filled with molten salt bath up to, and slightly over, the top of liner 110. As the level of bath drops and the aforementioned cooling occurs, protective crust 68 forms over bath 66 and solid or frozen portions 64 are formed over the now exposed portions of sidewall liner 110.

To further enhance the localized heat exchange, turbulator means 84 may be provided in entrance port 80 which may comprise a fibrous packing material or the like. The presence of turbulator means 84 serves to provide a more effective heat transfer from surface 44 to the air flowing through entrance port 80.

Figure 2:
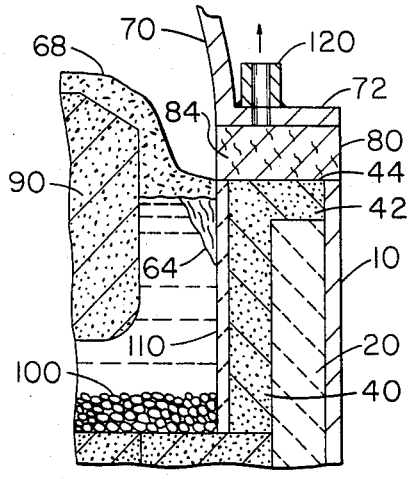
FIG. 2 is a fragmentary cross section of a portion of FIG. 1 illustrating an alternate embodiment.

Referring to FIG. 2, an alternate embodiment of the invention is illustrated wherein the cool air, entering at entrance port 80 exits the cell at exit port 120 located immediately adjacent thereto. Thus, the cool air passes over surface 44 to cool this surface sufficiently to form the desired protective crust portion 64 over the exposed portion of inert liner 110 but is not circulated over the frozen surface 68 of the bath. In this embodiment, then, the extracted heat is basically not returned to the cell. This is feasible since only a small portion of heat needs to be extracted to form the frozen portion 64.

Figure 3:
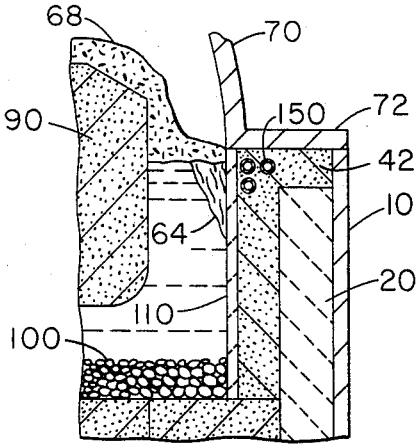
FIG. 3 is a fragmentary cross section of a portion of FIG. 1 illustrating yet another alternate embodiment.

In yet another embodiment, as shown in FIG. 3, the air entrance port 80 may be completely eliminated and the localized cooling accomplished by the provision of cooling coils 150 buried in carbon block portion 42 adjacent surface 44 and the exposed portion 110*a* of liner 110. Coolant circulating through coils 150 thus extracts sufficient heat locally in this embodiment to result in formation of the localized crust portion 64 over exposed liner portion 110*a*.

Thus, the invention provides a Hall cell structure capable of operating more efficiently by closer anode-cathode spacing while providing a combination of a liner and solidified bath over exposed portions of the liner to protect the carbon cathode sidewalls of the cell without endangering the operation of the cell by excessive heat removal. The small amount of heat removed to form the small portions of frozen bath over the inert layer above the molten bath level is returned at least in part to the cell by circulating the heated air over the frozen crust surface of the molten bath.

Having thus described the invention, what is claimed is:

1. An improved cell for electrolytic reduction of aluminum from a molten salt bath having a carbon cathode bottom wall and sidewall, a cover over said cell, at least one anode within said cell depending from an anode support rod passing through said cover, conductive means relatively inert to attack by said molten salt bath positioned over said carbon bottom wall to reduce the spacing between said anode and said cathode, conductive protective sidewall lining means relatively inert to attack by said molten salt bath on the inner surface of said carbon sidewall, and cooling means to cool an upper portion of said sidewall lining adjacent the surface of said molten salt bath to promote the formation of a protective layer of frozen bath over the portion of said sidewall lining adjacent the surface of said molten salt bath.

2. The improved cell of claim 1 wherein said means for cooling said portion of inert liner adjacent a molten bath-frozen crust interface comprises air entrance port means in said cover adjacent a top portion of said sidewall of said containment vessel to permit flow of cool air into said cell.

3. The improved cell of claim 1 wherein said cooling means comprise cooling coils adjacent said upper portion of said sidewall liner to cool said portion adjacent said bath sufficiently to form said protective layer of frozen bath over said portion of said sidewall adjacent the surface.

4. An improved Hall cell capable of efficiently producing aluminum by electrolytic reduction from a molten salt bath comprising a containment vessel having a bottom wall and a sidewall; a layer of insulation covering the inner surface of said bottom wall and a portion of said sidewall; a carbon cathode sidewall and bottom wall within said insulation layer; conductive lining means relatively inert to attack by said molten salt bath positioned over said carbon cathode sidewall; a cover member adapted to fit over said containment vessel; one or more anodes protruding into said containment vessel to a point adjacent said carbon bottom wall, said one or more anodes depending from anode support rods passing through said cover member; and means for cooling the exposed portion of said inert liner on said sidewall adjacent the interface between said molten salt bath and a frozen crust thereon whereby said exposed portion of said liner adjacent said interface will be covered by a protective layer of frozen bath and heat removed from said sidewall lining will be at least partially retained by said cell, said means for cooling said portion of inert liner adjacent said molten bath-frozen crust interface comprising port means in said cover located adjacent the normal operating level of molten bath within said cell to permit flow of cool air into said cell whereby said flow of air into said cell through said port means will selectively cool the portion of said inert liner adjacent said operating level to thereby selectively form said protective layer of frozen bath over said exposed portion of inert liner.

5. The improved Hall cell of claim 4 wherein said port means include turbulator means therein to improve the transfer of heat from said sidewall to said air.

6. The cell of claim 5 wherein said conductive protective sidewall lining means comprise a material selected from the class consisting of $TiB_2$, TiN, $ZrB_2$ and $NbB_2$.

7. A method of efficiently operating a Hall cell for the production of aluminum by electrolytic reduction from a molten salt bath wherein a containment vessel lined with insulation contains a carbon cathode bottom wall and sidewall and at least one anode protruding into said cell depends from an anode support rod passing through a cover over said cell, the improved method comprising:

(a) lining the carbon bottom wall of said cell with a conductive material resistive to attack by said molten salt bath to reduce the anode-cathode spacing to lower the electric power consumption per unit of reduced aluminum while protecting said carbon bottom wall from attach by molten aluminum:

(b) lining said carbon sidewall with a conductive sidewall lining material resistive to attack by said molten salt bath; and (c) selectively cooling an upper portion of said sidewall lining material adjacent the top of said molten salt bath to selectively form frozen bath on said sidewall lining adjacent the top of said molten bath to protect said sidewall lining exposed above said molten salt.

8. The method of claim 7 wherein said cooling step includes passing cool air from outside of said cell through an inlet port adjacent the top of said sidewall lining to cool said upper portion of said sidewall lining.

9. The method of claim 8 including the further step of circulating over the surface of said Hall cell said air used to cool said upper portion of said sidewall lining thereby retaining within said cell heat removed through said upper portion of said protective sidewall lining.

10. The method of claim 8 wherein said cooling step further includes the step of extending a portion of said carbon sidewall from the upper portion of said sidewall lining to said containment vessel above said insulation to provide a heat flow path from said sidewall lining to said containment vesssel adjacent the top of said sidewall lining to enhance the formation of frozen bath on said sidewall lining adjacent the top thereof.

11. The method of claim 8 wherein said cooling step further includes the use of a turbulator means adjacent said inlet port to promote the transfer of heat from said sidewall lining to said cool air.

12. An improved cell for electrolytic reduction of aluminum from a molten salt bath comprising:

(a) a carbon cathode bottom wall and sidewall:

(b) a cover over said cell;

(c) at least one anode in said cell depending from an anode support rod passing through said cover;

(d) conductive means relatively inert to attack by said molten salt bath positioned over said carbon bottom wall to reduce the spacing between said anode and said cathode;

(e) conductive protective sidewall lining means relatively inert to attack by said molten salt bath on the inner surface of said carbon sidewall (f) means for cooling said portion of inert sidewall liner adjacent a molten bath-frozen crust interface comprising air port entrance means in said cover adjacent a top portion of said sidewall of said containment vessel to permit flow of cool air into said cell to promote the selective formation of a protective layer of frozen bath over the portion of said sidewall lining adjacent the surface of said molten salt bath;

(g) a layer of insulation on the outside of said carbon bottom wall and sidewall terminating at a point spaced below said air entrance port means; and (h) a carbon sidewall portion above said termination point of said insulation layer extending laterally from said inert conductive lining to a sidewall of said containment vessel to enhance the flow of heat from said inert lining adjacent said molten bath-frozen crust to promote said selective formation of a protective layer of frozen bath over the exposed portion of said inert lining adjacent said interface.

13. The improved cell of claim 12 wherein said air entrance port means are located adjacent the normal operating level of molten bath within said cell whereby the flow of air into said cell through said port means will selectively cool the portion of said inert liner adjacent and above said operating level to thereby selectively form said protective layer of frozen bath over said exposed portion of inert liner.

14. The improved cell of claim 13 wherein said air flowing through said air entrance port means is subsequently circulated over the surface of the bath to thereby return to the cell heat extracted from said sidewall and inert liner.

15. The cell of claim 13 wherein said cooling air, entering said cell through said air entrance port, exits through an exit port adjacent said sidewall.

16. The improved cell of claim 13 wherein said air entrance port means include turbulator means therein to improve the transfer of heat from said sidewall to said air.

17. An improved cell for electrolytic reduction of aluminum from a molten salt bath comprising:

(a) a carbon cathode bottom wall and sidewall;

(b) a cover over said cell;

(c) at least one anode in said cell depending from an anode support rod passing through said cover;

(d) conductive means relatively inert to attack by said molten salt bath positioned over said carbon bottom wall to reduce the spacing between said anode and said cathode;

(e) conductive protective sidewall lining means relatively inert to attack by said molten salt bath on the inner surface of said carbon sidewall comprising a material selected from the class consisting of $TiB_2$, TiN, $ZrB_2$, and $NbB_2$; and (f) cooling means to cool an upper portion of said sidewall lining adjacent the surface of said molten salt bath to promote the formation of a protective layer of frozen bath over the portion of said sidewall lining adjacent the surface of said molten salt bath.

18. The cell of claim 17 wherein said conductive means over said carbon bottom wall comprise the same material as said conductive protective sidewall lining means.

19. The cell of claim 18 wherein said conductive means comprise particulated means having a particle size of about 1 to 5 centimeters.

20. The cell of claim 19 wherein said conductive means comprise one or more formed shapes having passageways therethrough to permit molten aluminum to pass to the bottom of the cell as it forms.

* * * * *